US006634433B2

(12) United States Patent
Kim et al.

(10) Patent No.: US 6,634,433 B2
(45) Date of Patent: Oct. 21, 2003

(54) INERT GAS GENERATOR FOR FIRE SUPPRESSING

(75) Inventors: Soo-Yong Kim, Daejon (KR); Ye-Hoon Im, Taejon (KR); Il-Su Yoo, Taejon (KR); Oleg F. Muravchenko, Zaporozhye (UA)

(73) Assignee: Korea Institute of Machinery and Materials, Taejon (KR)

( * ) Notice: Subject to any disclaimer, the term of this patent is extended or adjusted under 35 U.S.C. 154(b) by 0 days.

(21) Appl. No.: 10/193,956

(22) Filed: Jul. 12, 2002

(65) Prior Publication Data

US 2002/0166674 A1 Nov. 14, 2002

Related U.S. Application Data

(63) Continuation of application No. PCT/KR00/01389, filed on Nov. 30, 2000, now abandoned.

(51) Int. Cl.[7] ..... A62C 25/00
(52) U.S. Cl. ..... 169/52; 169/70; 169/11
(58) Field of Search ..... 169/51, 52, 70, 169/11, 12; 60/39.5, 39.511, 39.58

(56) References Cited

U.S. PATENT DOCUMENTS 3,841,270 A * 10/1974 Sokolowski ..... 122/7 R
4,113,019 A 9/1978 Sobolev et al.
5,046,564 A * 9/1991 Poulsen ..... 169/12
5,918,679 A * 7/1999 Cramer ..... 169/12
5,957,210 A * 9/1999 Cohrt et al. ..... 169/11
6,176,075 B1 * 1/2001 Griffin, Jr. ..... 60/775
6,179,608 B1 * 1/2001 Kraemer et al. ..... 239/552

FOREIGN PATENT DOCUMENTS

| | | |
|---|---|---|
| CN | 1110184 | 10/1995 |
| SU | 1724275 | 4/1992 |
| WO | WO-9318823 | 9/1993 |
| WO | WO 9318832 A1 | 9/1993 |

* cited by examiner

*Primary Examiner*—Christopher Kim
(74) *Attorney, Agent, or Firm*—David M. Tichane

(57) ABSTRACT

Disclosed in an inert gas generator to produce a large quantity of inert gas within a short period of time. The inert gas generator comprises: a gas turbine consisting of a starter motor, compressor, combustor and turbine body; an after-burner being connected to an exit of the gas turbine to re-burn gas burned in the combustor and being equipped with a flame stabilizer; a cooling chamber being equipped with spray nozzles to eject water to decrease gas temperature in the afterburner exit; an evaporator set to further cool the gas-steam mixture from the afterburner; a cooling chamber and spray nozzles; an exhaust nozzle to guide the direction of the inert gas-steam mixture of low temperature and oxygen content; and a controller for controlling the starter motor, the fuel pump and combustor. The inert gas generator mounted on a movable vehicle can promptly suppress the fire occurred in various places with least amount cost possible.

6 Claims, 3 Drawing Sheets

INERT GAS GENERATOR FOR FIRE SUPPRESSING

RELATED APPLICATION

This is a continuation of International Application PCT/KR00/01389, with an international filing date of Nov. 30, 2000, published in English under PCT Article 21(2) and now abandoned.

TECHNICAL FIELD

The present invention relates to a fire suppressing apparatus and more specifically to a gas generator to produce a large quantity of inert gas of low oxygen concentration within a short period of time. The present invention also relates to vehicles equipped with such gas generator to suppress fire.

BACKGROUND ART

In general, water or inert gases such as carbon dioxide, nitrogen, Halon1301, and Inergen have been used as means for fire suppressing. Among these, water is known to be the most effective fire suppressant and is also acknowledged to have the highest fire extinguishing effect. Here, fire-suppressing effect means both cooling and suffocating capabilities at time of fire suppressing.

However, in case water is used as a fire suppressant, it is required to cover all fired surfaces for complete extinction and therefore results in prolonging of fire suppressing time, thereby involves complicated problem of transporting a large quantity of water to the fire area. This inevitably makes the work less economical.

On the other hand, even though fire suppressants such as carbon dioxide, nitrogen, Halon1301, foam, etc., can temporarily suppress fire, their manufacturing cost are comparatively high and are usually intended for initial suppressing of fires of rather small size. Consequently, most of the fire suppressants existing today except water are thought to be not successful in suppressing fires of a great magnitude.

The sprinkler system has also been used effectively as a fire extinguishing equipment for fires occurring in large structures. The sprinkler system consists of a hydraulic pump to pressure the working-fluid, a valve to activate the fire alarm system with due connection to the hydraulic pump, an ejection nozzle and sprinkler head to distribute water to interior compartment. The sprinkler here includes a soluble link which melts at a preset indoor temperature at the time of fire and a deflector to distribute pressurized fluid with a certain degrees of angle.

However, this type of fire-extinguishing equipment has disadvantages in that it is required to spread the pressurized fluid through hydraulic pumps and therefore consumes a large amount of water. Sometimes it has malfunction due to increased interior temperature and accordingly requires a considerable time to suppress the fire. In reality, various types of scheme to initially suppress the fire are proposed as well as to improve its capability.

For instance, U.S. Pat. No. 4,113,019 discloses an inert gas generator for fire extinguishing using a turbo jet engine. According to the patent, the generator is equipped with diffuser at afterburner exit and a pressure reduction chamber sits between the afterburner and diffuser. The pressure reduction chamber is equipped with a manifold to which compressed inert gases such as nitrogen are introduced from outside. The compressed inert gases induced in the pressure reduction chamber will be decompressed and sent to the fire area. A diffuser will introduce the Freon gas into the exhausting inert gas thus increasing the fire suppressing efficiency.

However, U.S. Pat. No. 4,113,019 does not actually describe an equipment that produces inert gas as fire suppressant itself but acts as a simple introductory path to guide already manufactured inert gas of high kinetic energy by other mechanism to eject outward to the fire area. As this mechanism utilizes nitrogen and Freon gas as inert gas, the resulting cost for fire extinguishing tends to increase and brings harmful effect to the environment.

International Patent Laid-Open No. WO-9318823 discloses case where a turbo jet gas turbine is applied in fire suppressing. The turbo jet gas turbine is employed to spray water to the fire area utilizing high momentum existing at the gas turbine exit as well as to lower the exhaust gas temperature. The turbo jet gas turbine has often been used for special purposes such as suppressing the oil well fire by temporarily cutting off the oxygen entrainment from the atmosphere into the fire area but is known to have disadvantage of consuming too much water.

An USSR Pat. No. SU-1724275 discloses equipment for fire suppressing in a special region like an airport by spreading powdered inert gases with high temperature compressed air generated by a compressor. However, this system needs to have a separate power source and therefore, is difficult to operate for a longer time not to mention the difficulties in producing a large amount of inert gas.

Also, China Pat. No. CN-1110184 discloses a generator for driving a gas turbine. This generator intends to suppress the fire by transmitting a large quantity of water to the fire area by a water pump, but in general, is similar to conventional fire car and accordingly contains same drawbacks as others described above.

German Pat. No. DE-19625559 discloses a fire suppressing system using a small sized gas turbine in limited spaces like a ship's machine room or a small sized building. The equipment suppresses the fire by supplying nitrogen and water resulting from reaction of nitrogen and oxygen from the air. It has advantages that reaction material doesn't include other toxic components such as carbon dioxide or others and is friendly to the environment. Nevertheless, the system is known to have complicated manufacturing procedures and hard to produce large quantity of nitrogen and water thereby difficult confront fires in large scale.

DISCLOSURES OF INVENTION

The present invention is to solve the problems brought up thus far and a major purpose is to provide an inert gas generator and its associated system to suppress fires using a turbo generator gas turbine In addition, it is intended to produce a large amount of inert gases of low oxygen content and temperature through combustion processes in the turbo jet gas turbine and afterburner using an atmospheric air as its primary source.

Aforementioned objectives can be achieved by an inert gas generator for fire suppressing comprising: a gas turbine, which comprises a starter motor to drive initially the gas turbine, a compressor being connected to said starter motor, a combustor being connected to a fuel pump to burn air compressed in the compressor, and a turbine body installed at an exit of the combustor to generate power through expansion process; an afterburner being connected and installed at an exit of the turbine body, being connected to the compressor by a bleed off line to be provided with a portion of air extracted from the compressor for fuel atomizing and to re-bum gas burned in the combustor, and supplied through the turbine body, and being provided with a flame stabilizer to stabilize flame produced by re-burning of the gas burned in the combustor; a cooling chamber enclosing the afterburner to take combustion heat in the afterburner and to inject water through spray nozzles into gas re-burned in the afterburner to decrease temperature of the re-burned gas; an evaporator being installed at an exit of the cooling chamber for further cooling the re-burned gas which is already been cooled by the cooling chamber and the spray nozzles; an exhaust nozzle for guiding exhaust gas which has been cooled in the evaporator to a fire area; and a controller for controlling the starter motor, the fuel pump, the combustor and the afterburner.

According to the present invention, the inert gas generator comprises a starting motor system for supplying the power sufficient for the gas generator to reach self sustaining speed as it can not produce enough power to drive compressor and fuel pump system during low range of speeds. This starter motor will be separated once the system reaches the self-sustaining speed.

BEST MODE FOR CARRYING OUT THE INVENTION

Below, detailed explanation of the preferred embodiments of the present invention is made based on the attached drawings.

Figure 1:
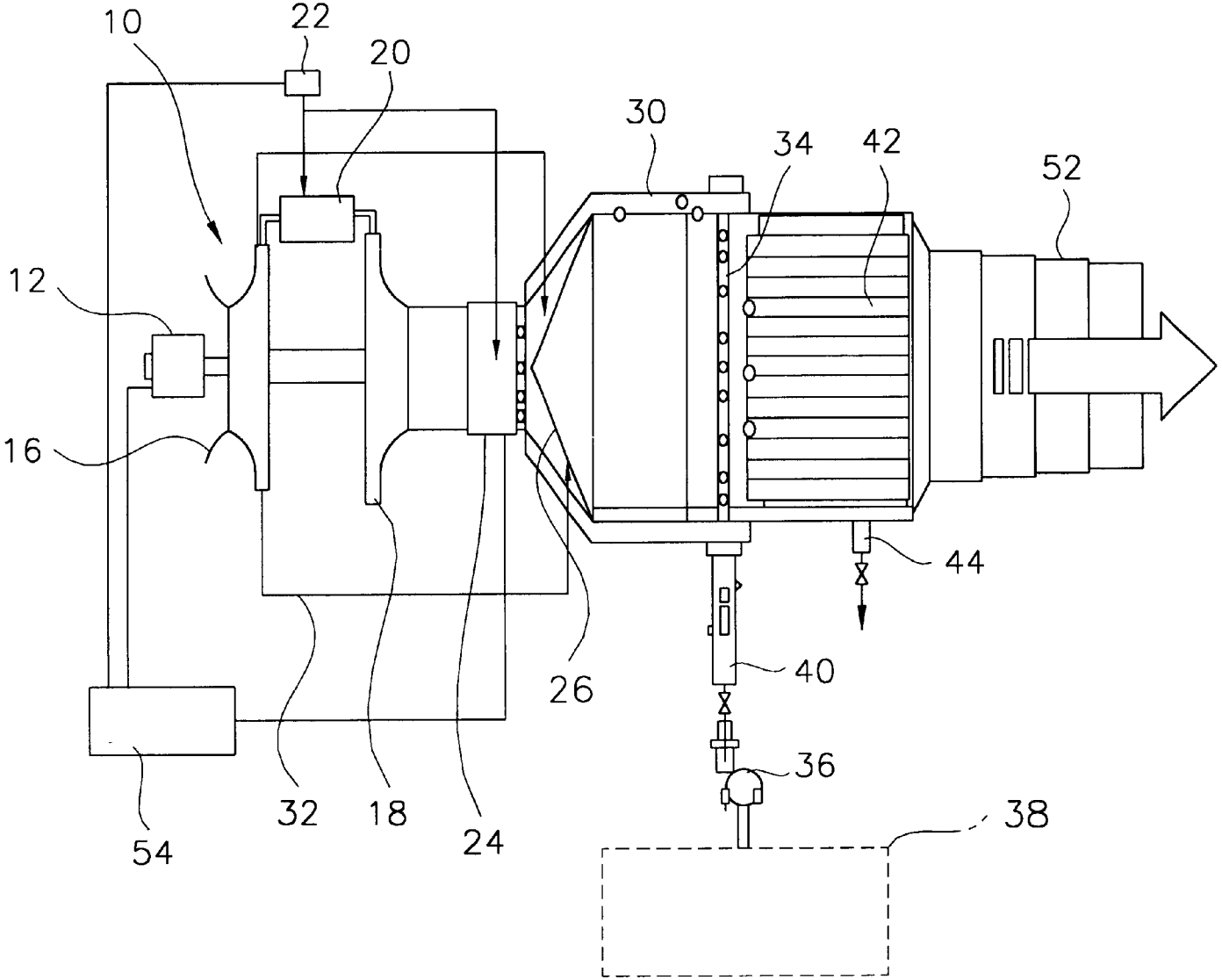
FIG. 1 is a general view of an inert gas generator system according to the preferred embodiment of the present invention.

Referring to FIG. 1, an inert gas generator as illustrated in the embodiment of present invention comprises a gas turbine 10. The gas turbine 10 is provided with a starter motor 12 for starting the gas turbine. The starter motor 12 intends to supply sufficient power for compressor and other auxiliary system in its initial driving speed range until the engine's speed of self-sustaining is met. The starter motor will be detached from the rest of the gas turbine once the engine achieves self-sustaining speed.

A compressor 14, which is coupled mechanically with the starter motor, will compress the air sucked in from the atmosphere. Both types of centrifugal and axial compressor can be employed in its configuration. It is desirable to have air intake device 16, as normally called "bell mouth", to introduce the air to the compressor. It is also necessary to constitute intake device 16 such way that a minimum pressure loss occurs in the compressor 14. A turbine body 18 is mechanically connected to the compressor 14 to cover compressor load and other auxiliary equipments.

A combustor 20 is installed between the compressor 14 and the turbine body 18. In the combustor 20, compressed air, except bleed off air to an afterburner as below detailed, will be burned. Naturally, a fuel pump 22 is connected to the combustor 20 to supply fuel to it.

An afterburner 24, attached to the turbine body 18, is to lower the oxygen content in the gas by re-burning the gas from the combustor 20. The afterburner 24 includes a flame stabilizer 26 as integrally connected to the exit of the turbine body 18 to stabilize the flame in the combustor 20. The fuel pump 22 is connected to the afterburner 24 for supplying of fuel. Particularly, a cooling chamber 30, which surrounds the afterburner 24, is to absorb the heat from the afterburner outer casing and at the same time to inject water to high temperature gas near the afterburner exit. Particularly, a portion of the extracted compressor air is introduced to the afterburner 24 through a bleed off line 32 for fuel atomizing.

Several spray nozzles 34 are installed at the exit of the cooling chamber 30 or in front of evaporator, as below detailed, for spraying of cooling water to reduce the gas temperature resulted from combustion of both the combustor and afterburner. It is desirable to have a water pump 36, a water tank 38, and water supply valve 40 connected to the spray nozzles 34 in series for controlling of cooling water flow rate. Also, the spray nozzles 34 are installed in the manifold in the manner that injection of water will be made with certain degree of angles to the direction of gas flow. This circumferential manifold is fixed to inner surface of the casing of the afterburner 24.

An evaporator 42 is attached to the exit of the cooling chamber 30 for further decreasing the temperature of already cooled gas. A drain valve 44 is installed at the bottom of the evaporator 42 to lead out the cooling water used in cooling process.

Figure 2:
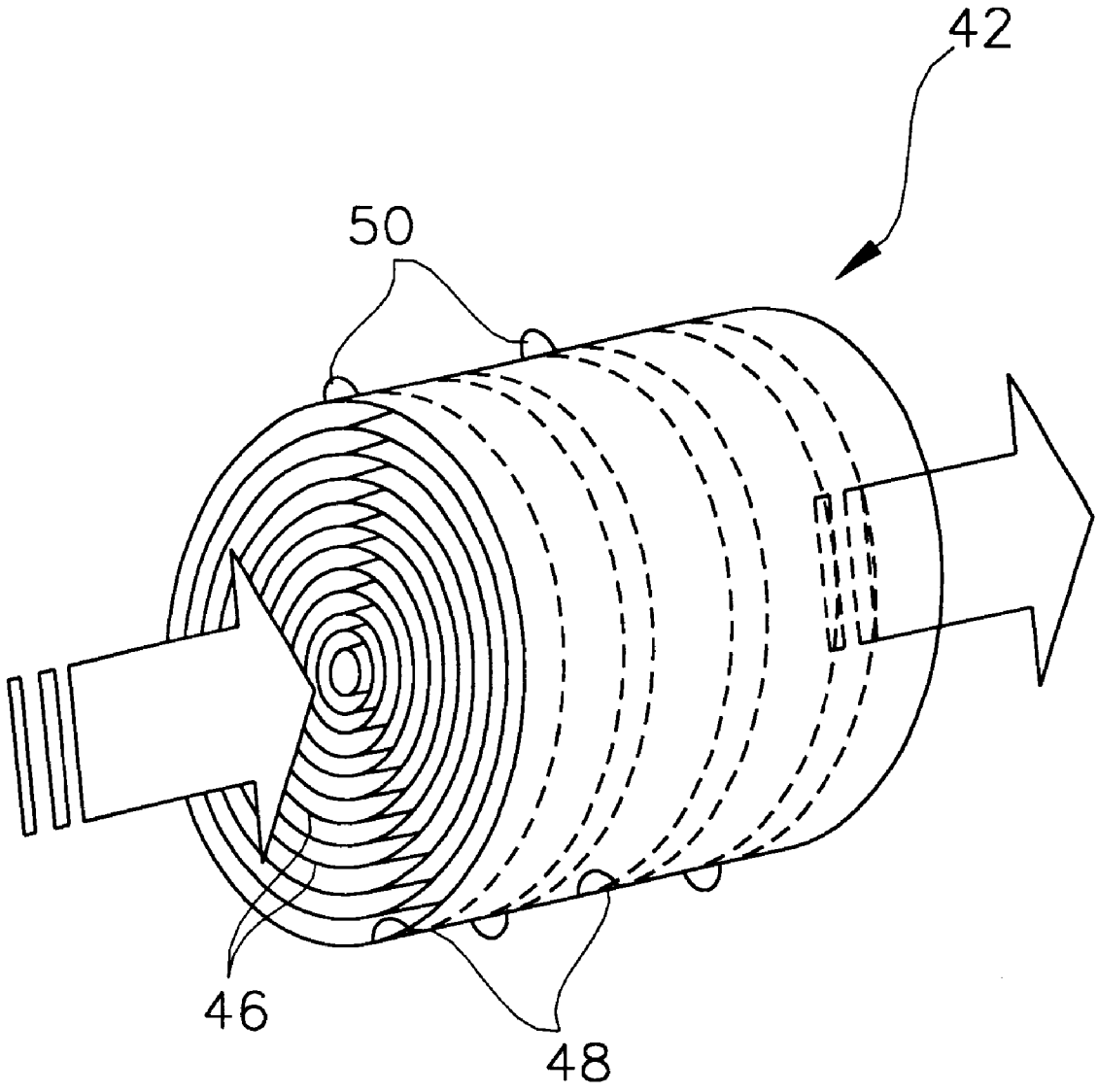
FIG. 2 is a perspective view showing evaporator system employed in the inert gas generator of FIG. 1.

In FIG. 2, it is desirable to constitute the evaporator 42 in the form of several coaxial-cylindrical bodies 46 with different diameters to increase the heat transfer surface areas. Each of coaxial-cylindrical bodies 46 is specially manufactured to have rugged surface of concave 48 and convex 50 in circumferential direction along the longitudinal distance. In this way it is intended to achieve higher heat transfer performance. The evaporator 42 is designed to have average gas-steam mixture temperature of 100° C. to 150° C. with a minimum longitudinal distance.

An exhaust nozzle 52 to lead out the evaporated exhaust gas (inert gas) is installed to the exit of the evaporator. This exhaust nozzle 52 can be extracted and contracted to accommodate the distance of inert gas to the fire area.

At the same time, the inert gas generator according to the present invention includes a controller 54 for automatic controlling. The controller 54 will control the system operation through operation of the starter motor 12 and accordingly the fuel pump 22 by monitoring of the fuel flow rate. The controller 54 controls combustion activities in both the combustor 20 and the afterburner 24.

Figure 3:
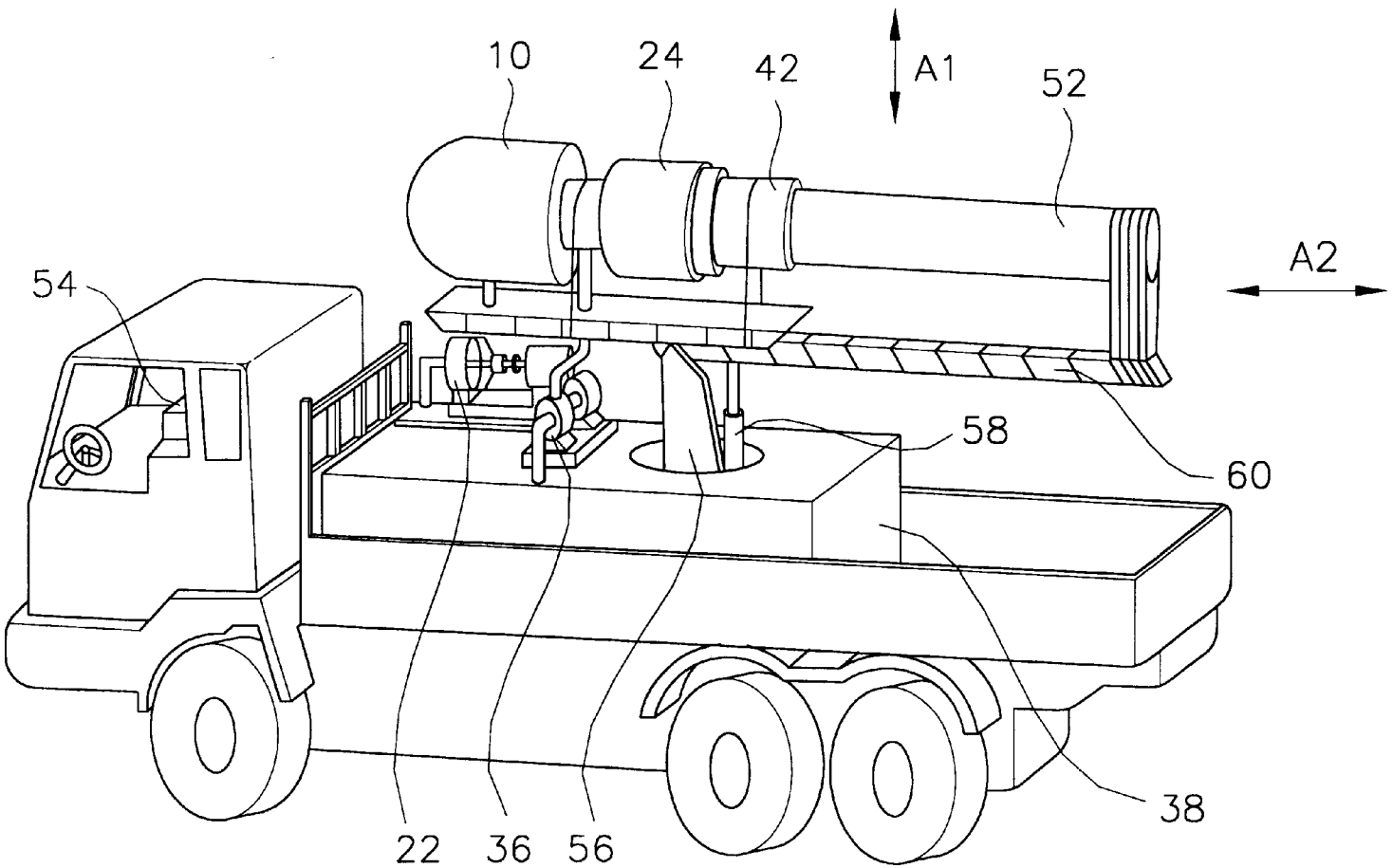
FIG. 3 is a perspective view showing the inert gas generator of FIG. 1 mounted on a movable vehicle.

According to the present invention, the inert gas generator as shown in FIG. 3, can be mounted on a vehicle such as truck to enhance its mobility. This means, an inert gas generator system consisting of the gas turbine 10, the afterburner 24, the evaporator 42, the exhaust nozzle 52 and others can be mounted in the vehicle such as, for example, a truck of 5 tons in loading capacity. It is also desired to operate the inert gas generator system associated with a crane 56 installed in the vehicle for enabling of both rotation and pitch motion of the inert gas generator. It is desirable to have a hydraulic cylinder 58 in order to control ejection angle of inert gas. The vehicle is equipped with a water tank 38 of a suitable volume and a water pump 36 in it to provide cooling water to the spray nozzles 34 (FIG. 1). Also, a fuel tank (not shown) to supply fuel to the combustor 20 and afterburner 24 will also be installed in the vehicle. Also a boom assembly 60 to control the distance of exhaust nozzle is included in the system.

The working principles of the inert gas generator, according to the present invention, are described in more detail hereinafter.

When a fire breaks out, for example, an operator or a fireman starts to operate the starter motor 12 by activating the controller 54 so that the turbine body 18 of the gas turbine 10 generates sufficient power to drive the compressor 14 and other auxiliary components. Once the turbine body 18 obtains high enough speed necessary for self-sustaining, the starter motor 12 will be detached and stops providing power to the turbine body 18.

As the compressor 14 starts to operate, it sucks in the atmospheric air through the air intake device 16 with a minimum pressure loss. The pressure and temperature of the air will be heightened as it passes through the compressor 14. A portion of the compressor air will bypass the combustor 20 and turbine body 18 to enter into the afterburner 24 through the bleed off line 32. The rest of the compressor air will flow through the combustor 20 to be burned with fuel supplied from the fuel pump 22. In this way, the compressed air turns into combustion product and a certain portion of oxygen component in the air will be consumed. This consumed amount of oxygen in the air depends on the temperatures at the inlet and the outlet of the combustor 20. The lower the inlet temperatures or higher the exit temperatures of the combustor 20, the less amount of oxygen will remain in the gas.

As the gas from the combustor 20 passes through the turbine body 18, it expands and the kinetic and heat energy in the gas turns into the mechanical energy. Herein, a portion of the energy generated by the turbine body 18 drives the compressor 14 and the other auxiliary components. The gas comes out from the turbine body 18 and enters into the afterburner 24 for further burning. With this continuing combustion process, the atmospheric air turns into inert gases of low oxygen content rate necessary as a fire suppressant. For instance, the oxygen content rate in the gas coming out of afterburner 24 becomes less than 10% of the atmospheric air. The temperature of the gas at this moment, is about 1800K~2100K in the combustor.

The gas with high temperature that comes out from the afterburner 24 is cooled by the cooling water sprayed from several spray nozzles 34 as it passes through the afterburner 24. This time the high temperature gas mixes with cooling water ejected from spray nozzles 34 and makes gas-steam mixture. The temperature of the gas-steam mixture is further decreased as it passes through evaporator 42. As shown in FIG. 2, the temperature of gas steam mixture that passes through coaxial-cylindrical bodies 46 of evaporator 42 can, for example, be dropped to 100° C.~150° C. by supplying the water of about less than 10 tons/h. The gas-steam mixture of reduced temperature will be ejected out through the exhaust nozzle 52 to suppress the fire. At this time, it is desirable to have the gas or gas-steam mixture temperature (partially it can include water drops) at the exit of the exhaust nozzle 52 kept at 100° C.~150° C.

The ejection angle of inert gas can be monitored by a crane system in case the gas generator is mounted on a vehicle as shown in FIG. 3. That means, the operator, for instance, can determine the direction of ejected inert gas from the inert gas generator by operating the crane 56 installed in the vehicle. In other words, by operating the controller near the driver cabin it is possible to manipulate the hydraulic cylinder 58 which support the inert gas generator frame, the operator can control the jet direction of the inert gas in the direction of arrow A1. Also, one can control the sprayed distance of the inert gas in the direction of arrow A2 by adjusting the exhaust nozzle 52 by controlling of the boom assembly 60. The power to drive the water pump 36 or the fuel pump 22 etc. can be provided using a separate battery or the power extracted from the vehicle's engine in its driving mode.

INDUSTRIAL APPLICABILITY

Based on the aforementioned invention, applicability and credibility of fire suppressing performance can be considerably enhanced by quickly spreading the inert gas of low temperature 100° C.~150° C. and oxygen content less than 10% produced in large quantity by the invented inert gas generator over the fire areas such as large structures, residential areas, ships and mountains or fires caused by military activities.

Furthermore, the cost for production of the concerned gas is much less than others methods as it uses atmospheric air and water as prime material sources and has the advantages of being environmentally harmless as it includes minimum toxic gases in the exhaust gas.

In addition, it has the advantages to minimize the damages in the facilities of high value and expensive electronics installed inside the structures by using a mixture of gas-steam instead of water during the time of fire suppressing.

While the preferred embodiment of the invention has been made with due explanations, it will be obvious to those skilled in the field of concerned technologies that the various changes in form and particulars can be made therein without departing from the main concepts and scope of the invention.

When a fire breaks out, for example, an operator or a fireman starts to operate the starter motor 12 by activating the controller 54 so that the turbine body 18 of the gas turbine 10 generates sufficient power to drive the compressor 14 and other auxiliary components. Once the turbine body 18 obtains high enough speed necessary for self-sustaining, the starter motor 12 will be detached and stops providing power to the turbine body 18.

As the compressor 14 starts to operate, it sucks in the atmospheric air through the air intake device 16 with a minimum pressure loss. The pressure and temperature of the air will be heightened as it passes through the compressor 14. A portion of the compressor air will bypass the combustor 20 and turbine body 18 to enter into the afterburner 24 through the bleed off line 32. The rest of the compressor air will flow through the combustor 20 to be burned with fuel supplied from the fuel pump 22. In this way, the compressed air turns into combustion product and a certain portion of oxygen component in the air will be consumed. This consumed amount of oxygen in the air depends on the temperatures at the inlet and the outlet of the combustor 20. The lower the inlet temperatures or higher the exit temperatures of the combustor 20, the less amount of oxygen will remain in the gas.

As the gas from the combustor 20 passes through the turbine body 18, it expands and the kinetic and heat energy in the gas turns into the mechanical energy. Herein, a portion of the energy generated by the turbine body 18 drives the compressor 14 and the other auxiliary components. The gas comes out from the turbine body 18 and enters into the afterburner 24 for further burning. With this continuing combustion process, the atmospheric air turns into inert gases of low oxygen content rate necessary as a fire suppressant. For instance, the oxygen content rate in the gas coming out of afterburner 24 becomes less than 10% of the atmospheric air. The temperature of the gas at this moment, is about 1800K~2100K in the combustor.

The gas with high temperature that comes out from the afterburner 24 is cooled by the cooling water sprayed from several spray nozzles 34 as it passes through the afterburner 24. This time the high temperature gas mixes with cooling water ejected from spray nozzles 34 and makes gas-steam mixture. The temperature of the gas-steam mixture is further decreased as it passes through evaporator 42. As shown in FIG. 2, the temperature of gas steam mixture that passes through coaxial-cylindrical bodies 46 of evaporator 42 can, for example, be dropped to 100° C.~150° C. by supplying the water of about less than 10 tons/h. The gas-steam mixture of reduced temperature will be ejected out through the exhaust nozzle 52 to suppress the fire. At this time, it is desirable to have the gas or gas-steam mixture temperature (partially it can include water drops) at the exit of the exhaust nozzle 52 kept at 100° C.~150° C.

The ejection angle of inert gas can be monitored by a crane system in case the gas generator is mounted on a vehicle as shown in FIG. 3. That means, the operator, for instance, can determine the direction of ejected inert gas from the inert gas generator by operating the crane 56 installed in the vehicle. In other words, by operating the controller near the driver cabin it is possible to manipulate the hydraulic cylinder 58 which support the inert gas generator frame, the operator can control the jet direction of the inert gas in the direction of arrow A1. Also, one can control the sprayed distance of the inert gas in the direction of arrow A2 by adjusting the exhaust nozzle 52 by controlling of the boom assembly 60. The power to drive the water pump 36 or the fuel pump 22 etc. can be provided using a separate battery or the power extracted from the vehicle's engine in its driving mode.

What is claimed is:

1. An inert gas generator for fire suppressing comprising:

a gas turbine, which comprises a starter motor, a combustor being connected to a fuel pump burn air compressed in the compressor, and a turbine body installed at an exit of the combustor to generate power through expansion process;

an afterburner being connected and installed at an exit of the turbine body, being connected to the compressor by a bleed off line to be provided with a portion of air extracted from the compressor for fuel atomizing and to re-burn gas burned in the combustor, and supplied through the turbine body, and being provided with a flame stabilizer to stabilize flame produced by re-burning of the gas burned in the combustor;

a cooling chamber enclosing the afterburner to take combustion heat in the afterburner and to inject water through spray nozzles into gas re-burned in the afterburner to decrease temperature of the re-burned gas;

an evaporator being installed at an exit of the cooling chamber for further cooling the re-burned gas which is already been cooled by the cooling chamber and the spray nozzles;

an exhaust nozzle for guiding exhaust gas which has been cooled in the evaporator to a fire area; and a controller for controlling the starter motor, the fuel pump, the combustor, and the afterburner.

2. The inert gas generator as claimed in claim 1 wherein a water tank, a water pump and a water supply valve are connected to the spray nozzles to regulate feed rate of the cooling water so that a concentration rate of oxygen in final exhaust gas can be controlled.

3. The inert gas generator as claimed in claim 1 wherein the evaporator includes coaxial-cylindrical bodies with different diameters to form gas transporting passages, and each of the coaxial-cylindrical bodies is formed with concave and convex parts in a circumferential direction along a longitudinal distance to increase heat transfer surface area in the coaxial-cylindrical bodies.

4. The inert gas generator as claimed in claim 3 wherein a drain valve is installed on a bottom of the evaporator for discharging used cooling water.

5. The inert gas generator as claimed in claim 1, wherein the exhaust nozzle can be contracted and expanded to adjust exhausting distance of the inert gas.

6. The inert gas generator as claimed in claim 1 further comprising;

a crane enabling the inert gas generator to rotate and to pitch;

a hydraulic cylinder for adjusting spray angle of the inert gas exhausted from the inert gas generator; and a boom assembly that can be expanded and contracted to adjust length of the exhaust nozzle of the inert gas generator.

* * * * *